United States Patent [19]

Perkins

[11] 4,424,797

[45] Jan. 10, 1984

[54] HEATING DEVICE

[76] Inventor: Eugene Perkins, Rte. One, Dawsonville, Ga. 30534

[21] Appl. No.: 311,074

[22] Filed: Oct. 13, 1981

[51] Int. Cl.[3] ..... F24C 9/00

[52] U.S. Cl. ..... 126/247; 122/26

[58] Field of Search ..... 126/247, 101; 122/26; 165/86; 188/293; 110/234; 237/8 A, 8 D, 56, 59; 236/9 A, 14, 37; 290/2; 415/90

[56] References Cited

U.S. PATENT DOCUMENTS

| | | | |
|---|---|---|---|
| 2,683,448 | 7/1954 | Smith | 126/247 |
| 3,813,036 | 5/1974 | Lutz | 126/247 X |
| 4,143,639 | 3/1979 | Frenette | 126/247 |
| 4,147,301 | 4/1979 | Halma et al. | 126/101 X |
| 4,153,199 | 5/1979 | Ellmer | 126/101 X |
| 4,357,931 | 11/1982 | Wolpert et al. | 126/247 |

*Primary Examiner*—Samuel Scott
*Assistant Examiner*—Randall L. Green
*Attorney, Agent, or Firm*—Scrivener, Clarke, Scrivener & Johnson

[57] ABSTRACT

A heater for heating a liquid including a housing defining a closed elongate heating chamber therein with a cylindrical chamber surface, a rotor body rotatably journalled in the heating chamber with a cylindrical peripheral surface thereon concentrically of the chamber surface so as to define an annular space between the chamber surface and the peripheral surface on the rotor body, drive means for effecting relative rotation between the rotor body and the housing, and pump means for circulating the liquid through the annular space so that the rotation of the rotor body heats the liquid passing through the annular space.

1 Claim, 4 Drawing Figures

HEATING DEVICE

BACKGROUND OF THE INVENTION

This invention relates generally to liquid heaters and more particularly to a liquid heater which heats liquid by shearing the liquid.

Various attempts have been made in the past to mechanically heat liquids. One type of such mechanical heating device heats the liquid by shearing the liquid between rotary and stationary blades in a chamber. A device of this type is illustrated in U.S. Pat. No. 2,683,448. This type of heating device creates a high degree of turbulence in the liquid passing through the device to be heated and consumes a large amount of power in driving the rotary blades in the chamber. As a result, the heating efficiency of this type of device is relatively low.

In another type of these prior art devices, the heat to heat the liquid is generated by the frictional contact between rotating and non-rotating members. Examples of this type of heating device are illustrated in U.S. Pat. Nos. 2,625,929; 3,164,147; and 3,402,702. The problems with this type of heating device are that a large amount of power is consumed in generating the frictional heat, and excessive wear is encountered between the surfaces of frictional contact with each other within the heating unit.

SUMMARY OF THE INVENTION

These and other problems and disadvantages associated with the prior art are overcome by the invention disclosed herein by providing a heating unit which uses a cylindrical rotor rotating in a cylindrical heating chamber so that the flow of liquid in the chamber is laminar rather than turbulent and with the rotor and chamber not being in contact with each other so that frictional losses within the heating unit are minimized. It has been found that sufficient liquid shear is generated by the rotating rotor in the heating chamber so that the liquid is heated, yet the power consumption associated therewith is minimized so that the heating efficiency of the unit is maximized.

The apparatus of the invention includes a heating unit which may be incorporated in a heating system adapted to heat air in a prescribed space such as a building or residence. The heating unit includes a housing which defines an elongate heating chamber therein with a cylindrical chamber surface. A rotor body is rotatably mounted in the heating chamber and defines a cylindrical peripheral surface thereon concentric with respect to the cylindrical chamber surface. The peripheral surface on the rotor has an outside diameter a prescribed amount smaller than the inside diameter of the chamber so as to define an annular space between the rotor body and the chamber through which the liquid to be heated is passed. Drive means is provided for effecting relative rotation between the rotor and the housing and pump means is provided for circulating the liquid through the annular space between the rotor and the chamber as the rotor is rotated so that the liquid is heated due to the shear of the liquid in the annular space between the rotor body and the chamber. In the embodiment of the invention shown, the pump impeller for circulating the liquid through the chamber is mounted on the rotor so that the drive means simultaneously rotates the pump impeller and the rotor.

When the heating unit is incorporated in a heating system, the liquid heated by the heating unit is passed through an air-to-liquid heat exchanger through which the air to be heated is also passed so that the air is heated as it passes through the heat exchanger. The operation of the heating unit is controlled so as to maintain the temperature of the air exiting the heat exchanger within a prescribed temperature range while the operation of the fan circulating the air through the heat exchanger is controlled in response to the temperature of the air in the conditioned space so as to maintain the temperature of the air in the conditioned space within a prescribed temperature range.

These and other features and advantages of the invention will become more apparent upon consideration of the following description and accompanying drawings wherein like characters of reference designate corresponding parts throughout the several views and in which:

These figures and the following detailed description disclose specific embodiments of the invention; however, it it to be understood that the inventive concept is not limited thereto since it may be incorporated in other forms.

DETAILED DESCRIPTION OF ILLUSTRATIVE EMBODIMENTS

Figure 1:
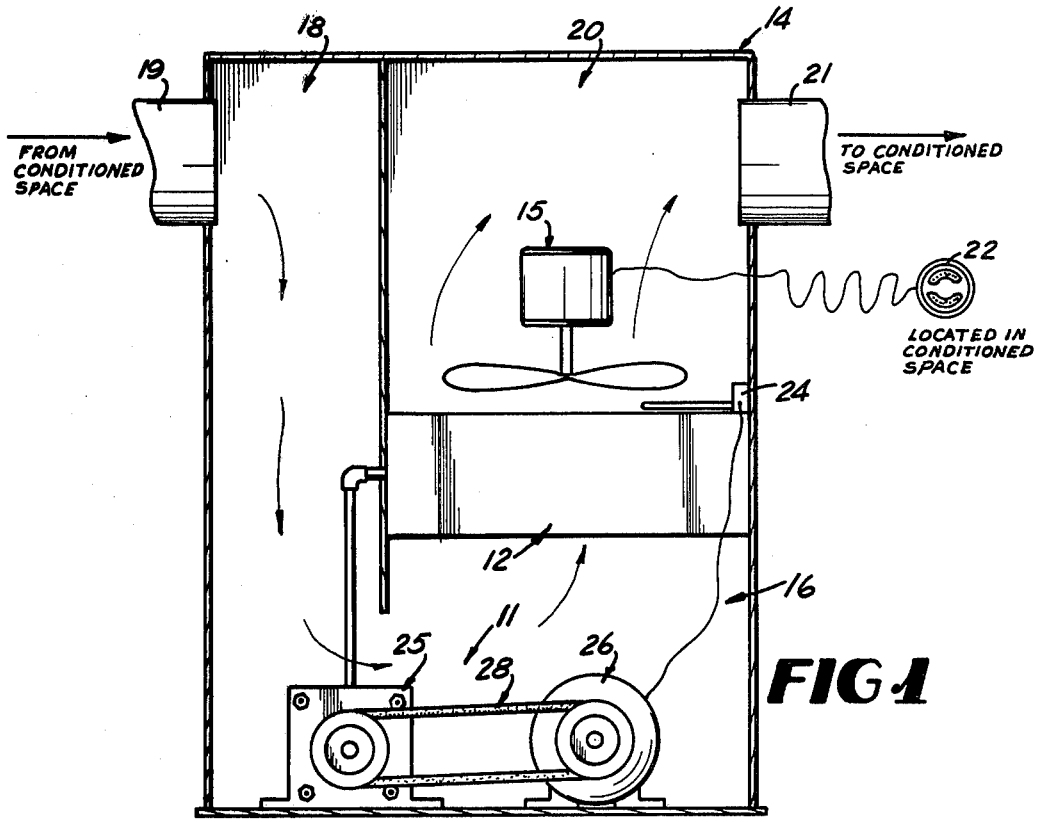
FIG. 1 is a view illustrating the invention incorporated in a heating system.

Referring to FIG. 1, it will be seen that the invention is embodied in a heating system 10 used to heat air in a space to be conditioned such as a building or residence. The heating system 10 includes generally a heating unit 11 connected to a liquid-to-air heat exchanger 12. The liquid-to-air heat exchanger 12 is housed in an appropriate duct system 14 adapted to supply air from the space to be conditioned to the heat exchanger 12 and to deliver air from the heat exchanger 12 back to the space to be conditioned. A fan 15 is provided in the duct system 14 for forcing the air from the space to be conditioned through the duct system 14 and the heat exchanger 12. The heating unit 11 is also illustrated housed in the duct system 14 although it is understood that it may be located remotely thereof.

The duct system 14 defines a heat exchanger chamber 16 therein in which the liquid-to-air heat exchanger 12 is mounted with an intake plenum 18 connected to the space to be conditioned by an appropriate return duct 19 so that the air from the space to be conditioned is supplied to the heat exchanger chamber 16 through the intake plenum 18. The air passing from the intake plenum 18 through the heat exchanger 12 in the chamber 16 passes out through a supply plenum 20 connected to the space to be conditioned by the supply duct 21 to supply the heated air back to the space to be conditioned. The fan 15 is located in the heat exchanger chamber 16 so that the fan 15 forces the air from the intake plenum 18 through the heat exchanger 12 in the chamber 16 and out through the supply plenum 20. It will be noted that the heat exchanger 12 extends completely across the chamber 16 so that all of the air passing from the intake plenum 18 to the supply plenum 20 must pass through the heat exchanger 12.

The operation of the fan 15 is controlled by thermostatic switch 22 which is located in the space to be conditioned so that when the temperature of the air in the space to be conditioned drops below a prescribed value, the switch 22 operates fan 15 to circulate air from the space to be conditioned through the heat exchanger 12 until the air in the space to be conditioned has been raised to a higher prescribed value. Such thermostatic switches 22 are conventional and need not be described in detail. As will become more apparent, the operation of the heating unit 11 is controlled by a thermostatic switch 24 located at the air exit side of the heat exchanger 12 as will become more apparent. The thermostatic switch 24 serves to activate the heating unit 11 when the air exiting the heat exchanger 12 drops to a prescribed lower temperature to heat a liquid and supply the liquid to heat exchanger 12 until the temperature of the air exiting the heat exchanger 12 has been raised to a prescribed higher temperature.

The heating unit 11 is illustrated mounted in the heat exchanger chamber 16 under the heat exchanger 12 and includes a liquid heater 25 driven by drive motor 26. In the particular embodiment shown, the drive motor 26 is connected to the liquid heater 25 through a bell and pulley arrangement 28. It is to be understood, however, that the drive motor 26 may be directly connected to the liquid heater 25.

Figure 2:
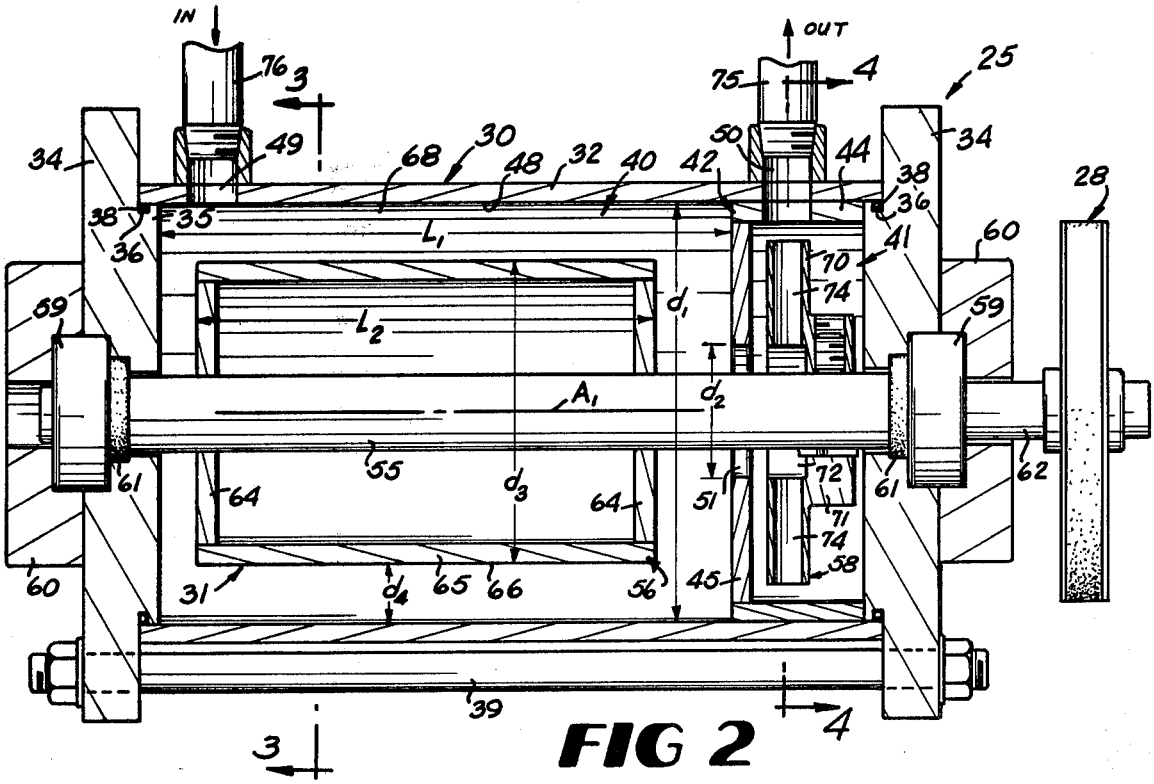
FIG. 2 is a longitudinal cross-sectional view of the heating unit of the invention.
Figure 3:
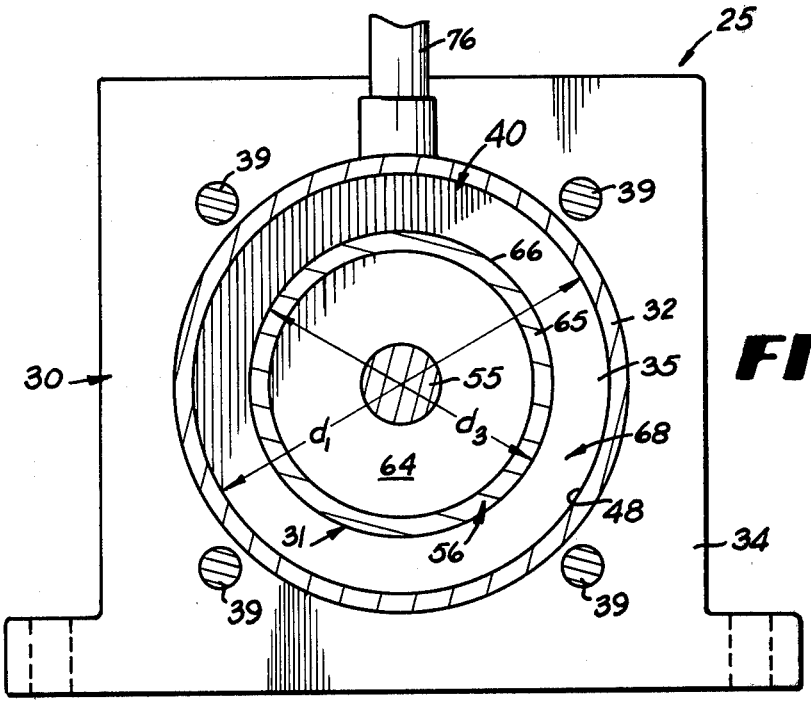
FIG. 3 is a transverse cross-sectional view taken generally along line 3—3 in FIG. 2.
Figure 4:
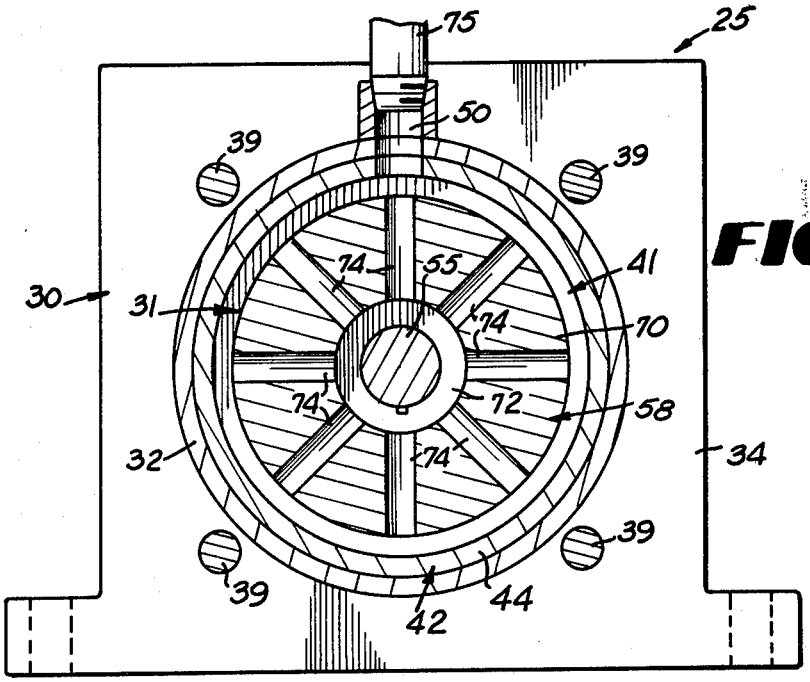
FIG. 4 is a transverse cross-sectional view taken generally along line 4—4 in FIG. 2.

As best seen in FIGS. 2–4, the liquid heater 25 includes a housing 30 in which is rotatably mounted a rotor assembly 31. The housing 30 is fixedly mounted in the heat exchanger chamber 16 while the rotor assembly 31 is rotated by the drive motor 26.

The housing 30 includes a cylindrical side wall 32 closed at opposite ends by end plates 34. Each of the end plates 34 defines a cylindrical projection 35 thereon which fits within the cylindrical side wall 32 and is provided with an annular groove 36 therearound which receives an O-ring 38 therein to seal the end plate 34 to the inside of the side wall 32. The end plates 34 are held in position by tie bolts 39 so that the closed chamber is defined by the side wall 32 and end plates 34. This chamber is divided into a heating chamber 40 and a pumping chamber 41 by a divider assembly 42. The divider assembly 42 includes an annular spacer wall 44 having an outside diameter so that it will snugly fit within the side walls 32 adjacent one of the end plates 34 so that spacer wall 44 projects a prescribed distance away from the end plate 34. The projecting end of the spacer wall 44 is closed by a circular end plate 45 so that the pumping chamber 41 is defined between the end plate 45, spacer wall 44, and the end plate 34 against which the spacer wall 44 abuts. The heating chamber 40 is thus defined between the end plate 45, the end plate 34 opposite that against which the divider assembly 42 abuts and the housing side wall 32. The heating chamber 40 has a diameter $d_1$ defined by the inside surface 48 of the side wall 32 and a length $L_1$ defined between the end plate 34 and the end plate 45. The side wall 32 defines an inlet opening 49 therethrough to the chamber 40 adjacent that end plate 34 opposite the divider assembly 42 while the spacer wall 44 and side wall 32 define a common outlet opening 50 therethrough which communicates with the pumping chamber 41. The circular end plate 45 on the divider assembly 42 defines a transfer opening 51 therethrough about the central axis $A_1$ of the chambers 40 and 41 of diameter $d_2$ so that the heating chamber 40 communicates with the pumping chamber 41 as will become more apparent.

The rotor assembly 31 includes a support shaft 55 which mounts a rotor body 56 thereon at one position along the length of the shaft 55 and a pump impeller 58 at another position along the support shaft 55. The rotor assembly 31 is mounted in the housing 30 so that the support shaft extends coaxially of the axis $A_1$ with the rotor body 56 located in the heating chamber 40 while the pump impeller 58 is located in the pumping chamber 41. The support shaft 55 extends through the transfer opening 51 through the end plate 45 in clearance therewith so that liquid can pass from the heating chamber 40 into the pumping chamber 41 and extends out through the end plates 34 through appropriate openings therein. The shaft 55 is rotatably journalled in bearings 59 mounted on each of the end plates 34 and held in position by retainers 60 on the outside of the end plates 34. A seal 61 is provided around shaft 55 immediately inboard of each of the bearings 59 to prevent liquid from passing out of the housing 30 around the shaft 55 at the end plates 34. The shaft 55 is provided with a drive projection 62 which extends out of the housing 30 through one of the retainers 60 so that the belt and pulley arrangement 28 can be connected thereto to rotate the support shaft 55.

The rotor body 56 is hollow and includes a pair of spaced apart washer-shaped end plates 64 which are fixedly attached to that portion of the support shaft 55 within the heating chamber 40 with one of the end plates 64 spaced inwardly of the end plate 34 and the other end plate 64 being spaced inwardly of the end plate 45. The end plates 64 are connected by an annular rotor side wall 65 which extends therebetween with the side wall 65 being fixedly attached to the end plates 64 and the end plates 64 being fixedly attached to the support shaft 55 so that the rotor body 56 rotates with the support shaft 55. The rotor side wall 65 defines a peripheral surface 66 thereon which is cylindrical and located concentrically of the central axis $A_1$ of the heating chamber 40. The surface 66 has a diameter $d_3$ which is a prescribed amount less than the inside diameter of the surface 48 so that surfaces 66 and 48 defines an annular space 68 therebetween of a radial distance $d_4$. The surface 66 has a length $L_2$ shorter than the length of the heating chamber 40.

The pump impeller 58 is fixedly attached to that portion of the support shaft 55 within the pumping chamber 41 and includes a disk portion 70 oriented perpendicular to the axis $A_1$ with an outside diameter slightly smaller than the inside diameter of the spacer wall 44 so that the pump impeller 58 is freely rotatable with shaft 55 in the pumping chamber 41. The pump impeller 58 also includes an attachment portion 71 used to attach the pump impeller 58 to the support shaft 55 through an appropriate key arrangement. The disk portion 70 defines a centrally located counterbore 72 therein which opens onto that side of the disk portion 70 facing the circular end plate 45. The counterbore 72 has a diameter larger than that of the support shaft 55 to define an annular cavity in the disk portion 70 around the shaft 55. The disk portion 70 further defines a plurality of radially extending passages 74 therein which open at their inboard ends into the counterbore 72 and open at their outboard ends into the outer periphery of the disk portion 70. The pump impeller 58 is attached to the support shaft 55 so that the passages 70 are aligned with the outlet opening 50 as they rotate within the pumping chamber 41. It will be seen that the diameter of the transfer opening 51 and the diameter of the counterbore 72 are such that liquid can freely pass from the heating chamber 40 through the transfer opening 51 and into the counterbore 72 so that the liquid will be forced outwardly along the passages 74 as the pump impeller 58 is rotated with the support shaft 55. As will become more apparent, this serves to force the liquid out of the housing 30 through the outlet opening 50. The outlet opening 50 is connected to one side of the heat exchanger through a supply pipe 75 while the inlet opening 49 to the housing 30 is connected to the other side of the heat exchanger through the return pipe 76.

In operation, it will be seen that the heating chamber 40 and the pumping chamber 41 as well as the passage through the heat exchanger and the pipe 75 and 76 are filled with a liquid to be heated such as water. When the drive motor 26 rotates the rotor assembly 31, this causes the rotor body 56 to be rotated in the heating chamber 40 while the pump impeller 58 is rotated in the pumping chamber 41. The pump impeller 58 pumps the liquid through the liquid heater 25 to the heat exchanger 12 and then back to the liquid heater 25 so that the heating chamber 40 and pumping chamber 41 remain filled with liquid at all times. As the rotor body 56 is rotated via the drive motor 26, the liquid at the cylindrical peripheral surface 66 on the rotor body 56 tries to move with the rotor body 56 while the liquid at the inside surface 48 on side wall 32 tries to remain stationary. This establishes a velocity gradient in the liquid across the annular space 68 between the rotor body 56 and the inside surface 48 of the side wall 32 to establish shear forces within this liquid. These shear forces cause the liquid to be heated. The velocity profile across the annular space 68 is such that the liquid in the annular space 68 remains in the laminar flow region so as to minimize the power consumption of the liquid heater 25. Thus, it will be seen that the liquid in the annular space 68 is being moved longitudinally of the annular space 68 by the pump impeller 58 while the liquid is moving circumferentially about the space 68 by the rotor body 56. This heats the liquid in the annular space 68 as it flows therealong and then flows out of the heating chamber 40 into the pumping chamber 41 where the pump impeller 58 pumps the liquid through the heat exchanger 12 so that the heat from the liquid can be transferred to the air passing through the heat exchanger 12.

It has been found that the temperature to which the liquid can be heated in the annular space 68 is dependent on the relative velocity of the cylindrical peripheral surface 66 with respect to the inside surface 48 on the side wall 32. When water is used as the liquid, rotating surface 66 at a velocity of about 1150 feet per minute heats the water to a temperature of about 140° F., rotating surface 66 at a velocity of about 1800 feet per minute heats the water to about 165° F., and rotating surface 66 at a velocity of about 2550 feet per minute heats the water to a temperature of about 210° F. Thus, it will be seen that the temperature to which the water can be heated can be adjusted by adjusting the rotational speed of the rotor body 56 to adjust the velocity of the peripheral surface 66 on the rotor body 56.

The radial distance $d_4$ of the annual space 68 affects the volume of liquid that will be heated by the rotating rotor body 56 at any one time. Distances of 0.06–1.0 inch for the distances $d_4$ have been found practical to reasonably heat the liquid passing through the annular space 68. A distance $d_4$ of about 0.75 inch has been found preferable to heat the liquid at a flow rate of about two gallons per minute.

The heating rate capacity of the liquid heater 25 is also dependent on the velocity of the cylindrical peripheral surface 66 on the rotor body 56. When water was used as the liquid to be heated, a velocity of about 1800 feet per minute generated about 19,000 BTU per hour whereas rotating the surface 66 at a velocity of about 2550 feet per minute generated about 25,500 BTU per hour. The volume of liquid in the liquid heater 25 and the system of the heat exchanger 12 and the liquid heater 25 should be such that the air passing through the heat exchanger 12 at a prescribed volumetric rate can be heated over the desired temperature differential. It is found that liquid heater 25 holding about one gallon of liquid with the system holding about three gallons of liquid is sufficient to heat air passing through the heat exchanger 12 at a volumetric rate of about 300 cfm about 40°–80° F. with a temperature differential in the liquid passing through the heat exchanger 12 of about 15°–20° F.

In the system illustrated, the diameter $d_1$ is about 5.5 inches, the diameter $d_3$ is about 4 inches, and the length $L_2$ of the surface 66 is about 6 inches. The drive motor 26 operates from a 115 volt power source and draws about 5.5 amps to rotate the rotor assembly 31 at about 2400 rpm to move the peripheral surface 66 on the rotor body 56 at a velocity of about 2550 feet per minute. Thus, the drive motor 26 has a power consumption of about 0.6 kilowatt per hour to produce a heating output of about 25,500 BTU per hour. In the above system, the fan 15 was operated to force air through the heat exchanger 12 at a flow rate of about 300 cfm. With the rotor assembly 31 rotating at about 2400 rpm, the air passing through the heat exchanger 12 was heated from a temperature of about 60° F. to a temperature of 100°–145° F. while the water temperature supplied to the heat exchanger 12 from the liquid heater 25 was at a temperature of about 210° F. and the temperature of the water returned to the liquid heater 25 from the heat exchanger 12 is at a temperature of about 185° F. At this rotational speed, the pump impeller 58 was pumping the water at a flow rate of about 2 gpm with a pressure differential of about 0.5 psi across the impeller 58. The thermostatic switch 22 in the space to be conditioned was set to maintain the temperature of the air in the space at about 71° F. while the thermostatic switch 24 was set to start operation of the liquid heater 25 when the temperature of the air exiting the heat exchanger 12 dropped to about 100° F. and to stop operation of the liquid heater 25 when the temperature of the air exiting the heat exchanger 12 reached about 140° F. Typically, the operating cycle for the fan 15 was about 10–12 minutes with the liquid heater 25 being operated for about two cycles of 1–2 minutes each during each operating cycle of the fan.

What is claimed as invention is:

1. Apparatus for heating a liquid comprising:

(a) a housing having an internal chamber bounded by a cylindrical wall and end walls, (b) a second chamber bounded by a cylindrical wall and end walls and being co-axial with the first chamber and communicating with the first chamber for free movement of liquid between them, (c) a rotatably mounted shaft extending axially through the two chambers, (d) a rotor mounted on the shaft within the first chamber and having a cylindrical surface spaced inwardly of the cylindrical surface of the chamber having a space between the cylindrical walls to be filled by a liquid, (e) a pump mounted on the shaft in the second chamber, (f) a fluid inlet port opening into the rotor chamber, and a fluid outlet port opening from the pump chamber, (g) a liquid filling the rotor chamber and the pump chamber, and (h) means for rotating the shaft, the rotor and the pump.

* * * * *